United States Patent [19]

Weetman

[11] Patent Number: 4,527,904

[45] Date of Patent: Jul. 9, 1985

[54] MEASUREMENT OF FLUID FORCES IN MIXING APPARATUS AND THE CONTROL OF MIXING APPARATUS IN RESPONSE TO FLUID FORCES

[75] Inventor: Ronald J. Weetman, Rochester, N.Y.

[73] Assignee: General Signal Corporation, Stamford, Conn.

[21] Appl. No.: 619,971

[22] Filed: Jun. 12, 1984

[51] Int. Cl.[3] ..... B01F 15/04

[52] U.S. Cl. ..... 366/348; 366/349; 366/601; 318/466

[58] Field of Search ..... 366/279, 601, 280, 285, 366/286, 348, 349, 241, 249, 251, 253, 252, 254; 73/862.31, 59, 37; 318/466

[56] References Cited

U.S. PATENT DOCUMENTS

| | | | |
|---|---|---|---|
| 2,452,142 | 10/1948 | Pecker | 366/601 |
| 3,169,395 | 2/1965 | Enoch | 366/325 |
| 3,676,723 | 7/1972 | Drucker | 318/466 |
| 4,340,310 | 7/1982 | Clark | 366/601 |

*Primary Examiner*—Robert W. Jenkins
*Attorney, Agent, or Firm*—Martin LuKacher

[57] ABSTRACT

Fluid forces acting on the impeller of mixing apparatus which produce bending movement (deflection) of the impeller shaft which may adversely effect the operation of the mixing apparatus are measured by detecting the movement of a non-rotating component of the mixing apparatus, namely the gear box which, together with a drive motor, constitutes the drive mechanism of the mixing apparatus. The gear box is flexurally supported on beams spanning the tank into which the shaft and impeller extend. A gage in proximity to the gear box, and preferably perpendicular to the axis of the beam, provides output signals in response to the displacement (distance) of an exterior wall of the gear box therefrom. These output signals are processed and used to control the motor, as by reducing the speed of the motor in response to fluid forces exceeding a certain level thereby reducing such forces or stopping the motor thereby preventing any damage to the shaft. The movement of the gear box and the corresponding output signals from the gage have been found to correlate directly with the deflection of the shaft in response to fluid forces, even though the gear box does not rotate with the shaft, and this correlation occurs over the entire dynamic range of the fluid forces.

34 Claims, 5 Drawing Figures

PD1
PR
64
AMPL
(LOG-V)
(SPOG-)
0
0
10
FREQ (HZ)

MEASUREMENT OF FLUID FORCES IN MIXING APPARATUS AND THE CONTROL OF MIXING APPARATUS IN RESPONSE TO FLUID FORCES

DESCRIPTION

The present invention relates to mixing systems, and particularly to methods and systems for measuring fluid forces acting on the impellers and shafts of mixing systems and for the control of mixing system in response to such fluid forces.

The invention is especially suitable for use in mixing systems which are susceptible to large fluid forces which may permanently bend or even break the impeller shaft of the mixing system, especially at draw-off or with impellers operating near the liquid surface.

Fluid forces are the main mechanical forces on the mixer shaft. They are generated at the impeller perpendicular to shaft axis and produce large bending movement (deflection) on the top of the shaft and on the drive mechanism (particularly the gear box of the drive mechanism which contains reducer gears and drives the shaft). In closed tanks having seals through which the shaft passes, these forces can damage the seal. Fluid forces are discussed in detail in Chapter 17 of the text, *Fluid Mixing Technology* by J. Oldsue, McGraw-Hill (1983). They're also described in article by R. J. Weetman and R. N. Salzman, *Chemical Engineering Progess*, pp. 71–75 (June 1981).

Fluid force measurements have required laboratory instrumentation such as strain gages or strain gage bridges which are connected to the impeller shaft. Electrical connections to such instrumentation must be brought out of the mixing system by way of slip rings. Optical systems which respond to light reflected from the shaft has also been used to measure the deflection of the shaft in response to the fluid forces. Since the fluid forces are greatest near the impeller which is submerged in the material being mixed, the optical devices must be located on the shaft well above the surface of the material being mixed. Since the deflection is small at such locations, the optical devices must be sensitive. The use of slip rings and sensitive optical devices has constrained the measurement of fluid forces to laboratory environments. The various instruments for measuring fluid forces mentioned above are discussed in greater detail in the above-referenced publications.

It has been discovered, unexpectedly, and in accordance with this invention that measurement of the movement of the drive mechanism, particularly the gear box which drives and supports the impeller shaft, has a direct correlation to fluid forces acting on the impeller. This discovery is unexpected in that the mixing system is a complex mechanical system having a complex frequency response, such that the deflection of the non-rotating portion of the system, namely the drive mechanism, would not be considered to correlate directly with the fluid forces. Moreover, prior measurements of fluid forces have depended upon instruments attached to and rotating with the impeller shaft. Even with such instruments the measurements have been difficult to make in that the runout of the shaft under no load conditions can be greater than the deflection of the shaft caused by the fluid forces. Accordingly, measuring fluid forces in response to the movement of drive mechanism which is supported over the tank and which does not rotate represents a significant improvement and simplification. The measurement is made well away from the material being mixed. The measurement can be made above the cover of a closed tank, such that contamination of the instrumentation from the material being mixed is precluded. The output of the measurement is useful in controlling the operation of the mixing system, as to prevent damage or unsafe conditions which can arise in the presence of excessive fluid forces. For example, the speed of the impeller can be reduced when excessive fluid forces are detected, thereby reducing the fluid forces and preventing any damage to the mixing system which might result if such forces become excessive.

Accordingly, it is a principal object of the present invention to provide improved mixing systems.

It is another object of the present invention to provide improved methods and systems for the measurement of fluid forces.

It is a further object of the present invention to provide improved methods and systems for the control of mixing systems in response to fluid forces.

Briefly described, a mixing system in accordance with the invention has a motor-driven drive mechanism coupled to a shaft having an impeller thereon. The shaft is disposed in a tank for mixing material therein. The system is controlled in response to fluid forces on the impeller, which deflect the shaft, by detecting the movement of the drive mechanism, which does not rotate, preferably by the use of a proximity gage disposed adjacent to the gear box of the drive mechanism. Signals are produced representing the fluid forces in response to the detected movement of the drive mechanism. The motor of the mixing system is controlled in response to these signals. When the fluid forces become excessive, the motor may be switched to operate at lower speed or even stopped. Accordingly, damage to the mixing system which might result from excessive fluid forces is precluded and safe operation of the system is assured.

The foregoing and other objects, features and advantages of the invention, as well as a presently preferred embodiment thereof and the best modes now known for practicing the invention, will become more apparent from reading the following description in connection with the accompanying drawings in which.

Figure 1:
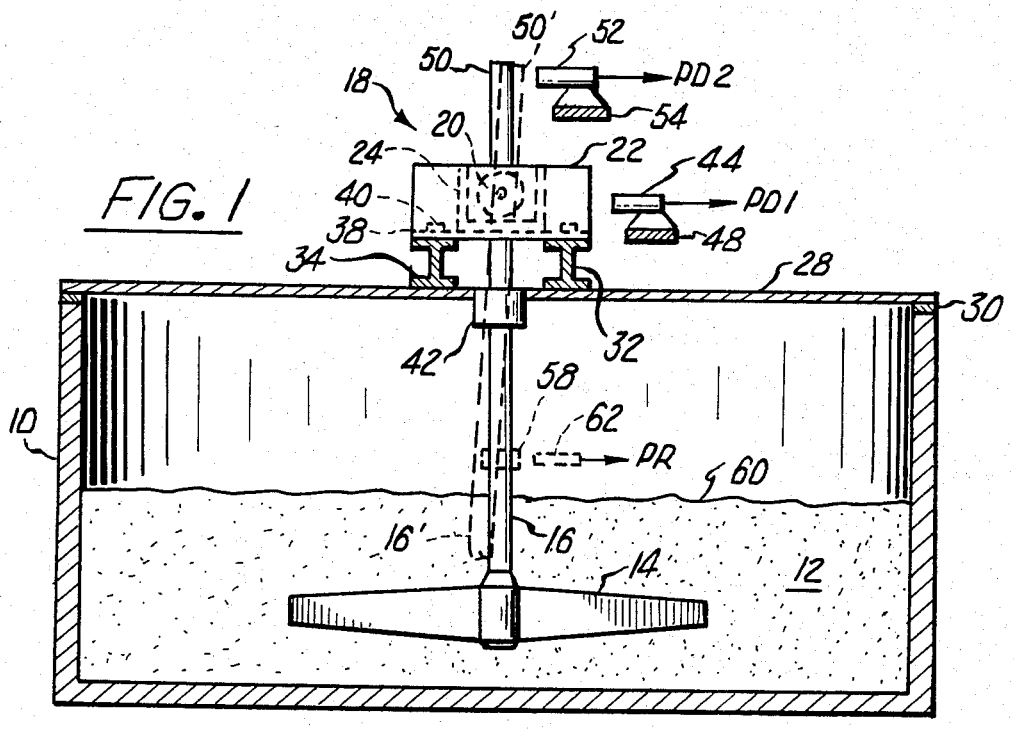
FIG. 1 is a sectional view showing a mixing system embodying the invention, the view being taken along the lines 1—1 in FIG. 2.
Figure 2:
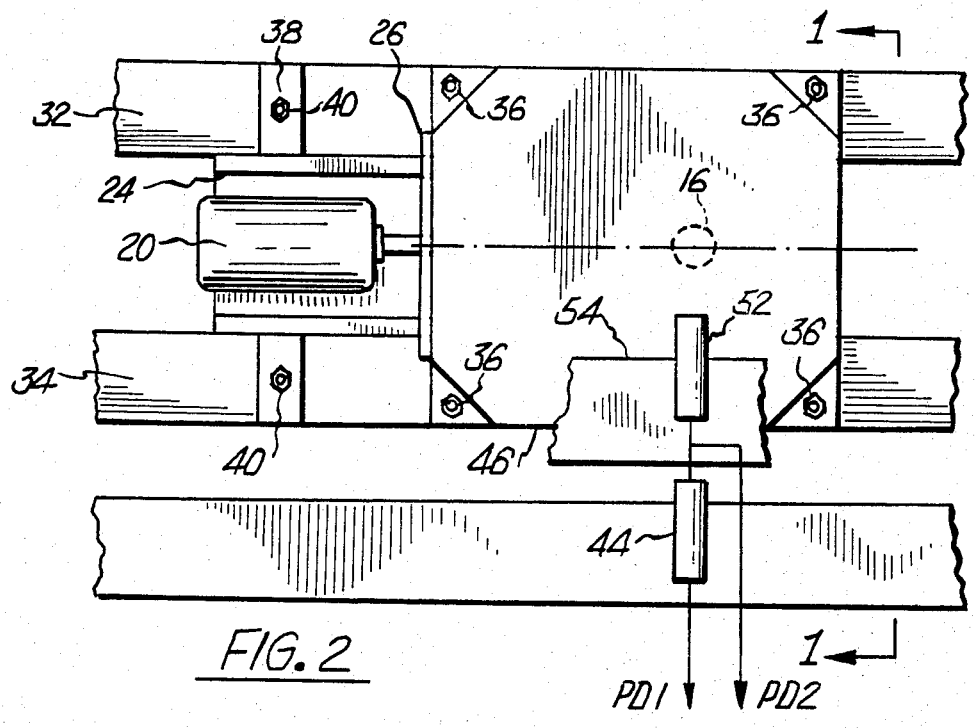
FIG. 2 is a fragmentary plan view of the apparatus shown in FIG. 1.

Referring more particularly to FIGS. 1 and 2 of the drawings, there is shown a tank 10 having a liquid suspension 12 which is mixed by an impeller 14 mounted on an impeller shaft 16. The impeller is driven by a drive mechanism 18. The drive mechanism 18 is made up of a drive motor 20 and a gear reducer assembly in a gear box 22. The motor is mounted in a channel 24 attached by a front plate 26 to the gear box 22.

The tank may be a closed tank having a cover 28 connected to the walls of the tank, which may be either round or rectilinear, (rectangular or square). The cover 28 bears on gaskets 30 lining the upper ends of the walls of the tank 10. The tank may be approximately 5 to 70 feet in diameter or width. The tank is spanned by wide flanged I-beams 32 and 34 which provide a flexural support for the drive mechanism. The gear box 22 may be bolted to the beams by bolts 36. The channel 24, mounting the motor 20, may be connected to a bracket 38 which is also bolted to the beams 32 and 34 by bolts 40.

The mixer shaft 16 is cantilever supported from bearings in the gear box 22, and extends through an opening in the cover 28. The opening is closed by a seal assembly 42.

A proximity gage 44 is mounted in a fixed position adjacent to the exterior surface 46 of the gear box 22 on a support member 48. This proximity gage is preferably a magnetic flux density responsive gage of the type which is commercially available. A gage having a range of 100 mils (100 times 0.001 in.) is preferably used. The nose of such a gage may have a 5 millimeter diameter. This nose may be positioned approximately 50 mils from the exterior surface 46 of the gear box 22 so as to respond to the movement (displacement) of the gear box 22. The gear box is made of metal, preferably steel, so that the distance between the nose of the gage 44 and the surface 46 changes the flux density in the gap between the nose and the surface. The gage therefore provides an accurate response to the flux gap length and therefore of the movement of the gear box 22.

A rod 50 projects upwardly from the gear box 22 along the axis of the shaft 16 (in an axially direction opposite to the direction of the shaft 16). This rod is also preferably made of metal (steel). Another proximity gage 52 is mounted on a support member 54 adjacent to the top of the member 50. The member 50 serves to amplify the movement of the gear box. Therefore the proximity gage 52 may have a larger diameter nose than the gage 44 and a larger range, (for example one inch). The nose of the gage 52 may be spaced from the side of the rod 50 adjacent to which it is disposed by approximately $\frac{1}{2}$ of the range. The spacings mentioned above are, of course, with the shaft non-rotating.

The beams 32 and 34 provide a flexural support allowing maximum pivotal movement (rocking) of the gear box about a flexure axis 56 (FIG. 2) which intersects the axis of the shaft 16 and is perpendicular thereto. The gages are perpendicular to this axis and therefore respond to the pivotal movement or deflection of the gear box together with the shaft 16. The deflection in one direction due to fluid forces operative upon the impeller shaft are illustrated by the dash lines for the shaft 16' and for the amplifying rod 50 at 50'. It will be noted that the deflection of the member 50 and the movement of the gear box 22 is 180 degrees out of phase with the deflection of the shaft.

The gage 44 provides and output signal PD1. The gage 52 provides an output signal PD2. These signals are used for control of the mixing system, by controlling the speed of the motor 20 to the use of the system of FIG. 3 in accordance with this preferred embodiment of the invention. Other uses of the signals will of course become apparent to those skilled in the art.

In order to verify that the movement of the gear box 22, even though it is non-rotating, correlates directly with the deflection of the shaft 16, a ring 58 is provided around the shaft 16 above the surface 60 of the material 12 in the tank 10. This ring 50 is machined to zero out the non-load runout of the shaft. Another proximity gage 62 is disposed adjacent to the ring 58. The ring 58 and the gage 62 are illustrated in lines consisting of long and short dashes to show that they are not used in operation of the system, but are presented herein merely to explain how the direct correlation is verified between the deflection of the shaft 16 in response to fluid forces on the impeller with the outputs from the gages which respond to the movement of the gear box 22.

Figure 4:
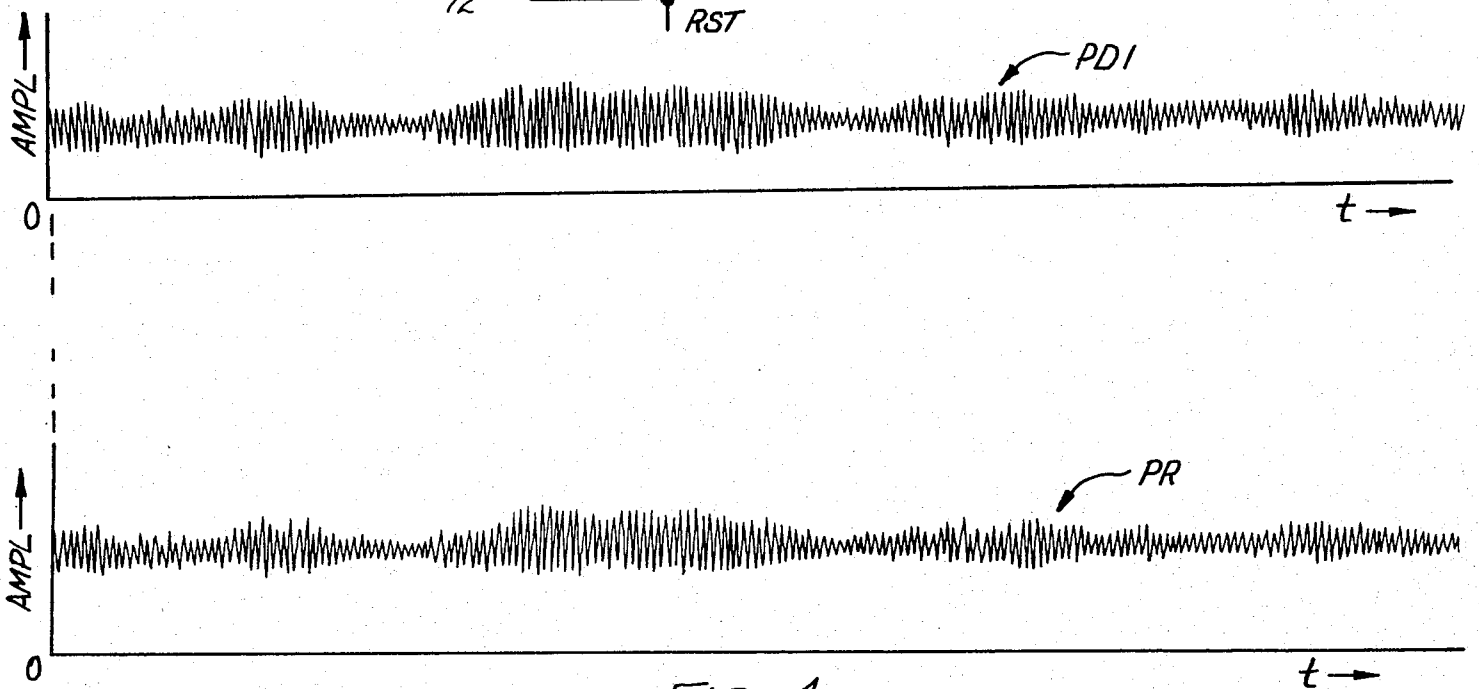
FIG. 4 shows curves showing representative signals obtained from the proximity gages used in the system shown in FIGS. 1 and 2.
Figure 5:
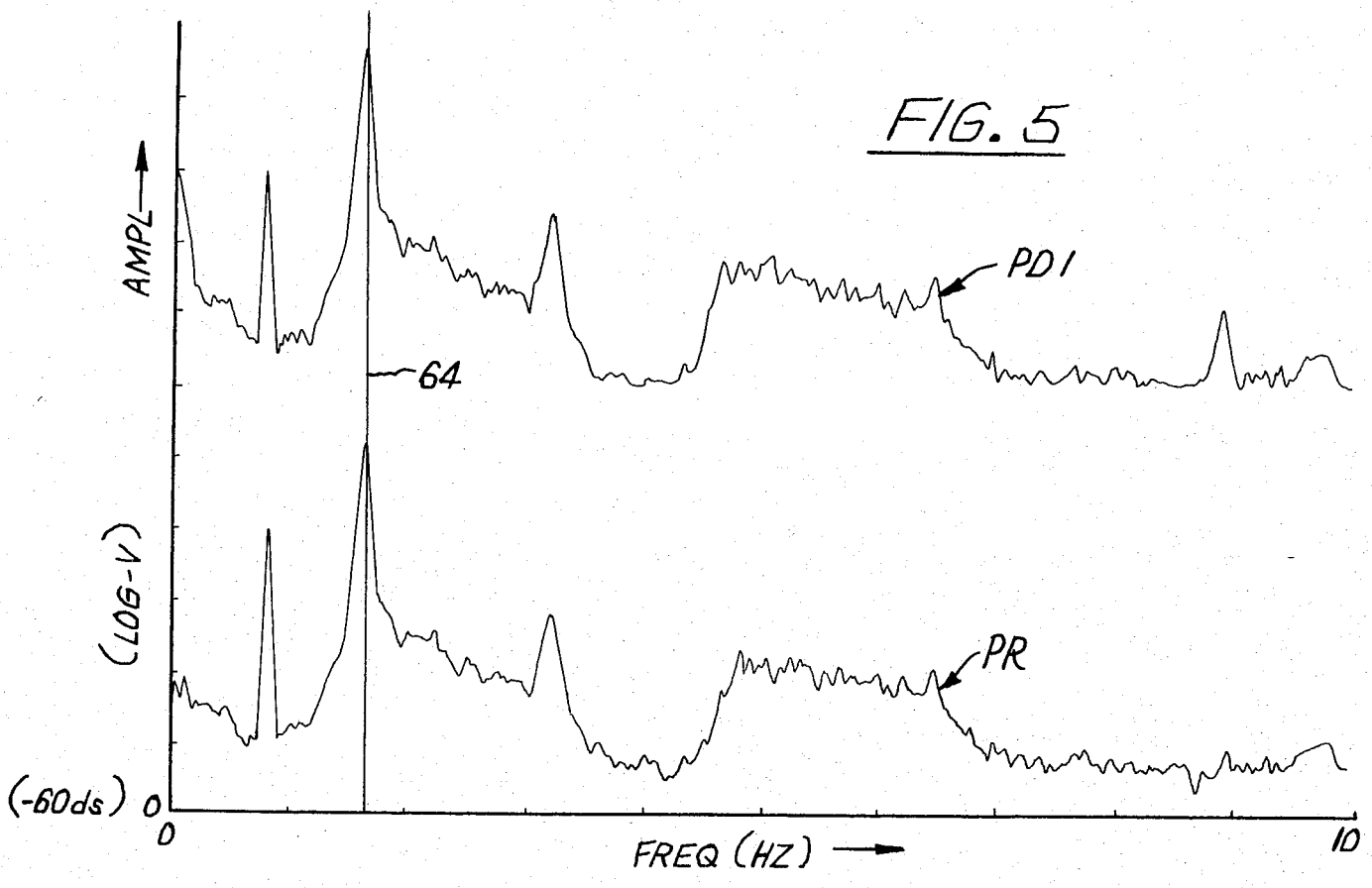
FIG. 5 shows other curves depicting the frequency response of the signals shown in FIG. 4.

Referring to FIG. 4, there is shown the curve representing the amplitude variation with time of the signal PD1 as well as amplitude variation with time of the signal PR from the gage 62. It will be noted that the signals are essentially similar in wave form. Because the mixing system is a complex mechanical system the dynamic response over the frequency range, up to for example the first critical speed of the shaft over which the signals may be taken, also shows how well they correlate. FIG. 5 illustrates the frequency response of the signals. It will be observed that they correlate closely. Most important at the frequency at maximum amplitude (where the fluid forces are the greatest which is shown at the frequency indicated by the cursor 64). The signals correllate very closely.

The curves of FIG. 4 and FIG. 5 are taken with a 180 degree phase shift so as to display them in in-phase relationship, notwithstanding that the deflection of the shaft 16 seen by the gage 62 is 180 degrees out of phase with the movement of the gear box 22, as sensed by the gage 44. The signals also have a different DC level off-set. Neglecting this off set, which can be accommodated readily in the amplifiers which amplify these signals from the gages, the direct correlation between the signals will be apparent from FIGS. 4 and 5.

Figure 3:
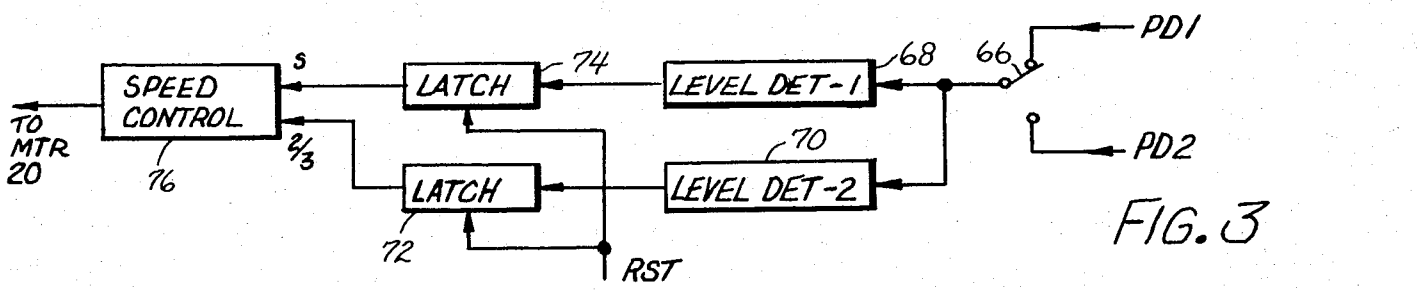
FIG. 3 is a block diagram of the electronics for controlling the motor of the drive mechanism of the mixing systems shown in Figs. 1 and 2 in response to signals corresponding to the fluid forces on the impeller of the mixing system.

Referring to FIG. 3 the signals PD1 and PD2 are provided to a switch 66. These signals may be suitably amplified and conditioned prior to being applied to the switch 66. One of the signals is selected by the switch, depending upon the amplitude range of the fluid forces. For example if the fluid forces are relatively low the signals PD2 are selected, otherwise signals PD1 are used.

Assuming the signal PD1 is used, it is applied to two level detectors, 68 and 70. These may be threshold circuits wherein the peak amplitude of the PD1 signals is compared to a fixed threshold. The threshold of the first detector 68 may be higher than that of the second detector 70. The signals which are applied to the detectors may be filtered to remove any high frequency artifacts or noise which might be mistaken as a signal representative of the fluid forces. If the signals exceed the threshold of the second detector 70, an output is provided which sets a latch circuit 72. Similarly, if a signal which exceeds the threshold of the first detector 68 occurs it sets another latch 74. If the latch 72 is set, an output is provided to the speed control circuit 76 of the motor to reduce the speed to $\frac{2}{3}$ the operating speed during normal mixing. If the latch 72 is set, the speed control responds to the output of the latch 74 by stopping the motor. Accordingly, any excessive fluid forces result in a change in the speed of the motor to immediately reduce the fluid forces and prevent damage or any unsafe operation of the system. Normal speed operation may be resumed by applying a re-set input to the latches 72 & 74.

The electronics illustrated in FIG. 3 may also be implemented by a suitably programmed micro-processor which performs other control functions in the mixing system.

From the foregoing description it will be apparent that there has been provided an improved mixing system wherein fluid forces may be measured and used to control the operation of the system. Variations and modifications of the herein described system and the methods of measuring fluid forces and the control of the system and response thereto, within the scope of the invention, will undoubtedly suggest themselves to those skilled in the art. For example, a typical installation may use only one gage, either 44 or 52, and not both. Accordingly, the foregoing description should be taken as illustrative and not in a limiting sense.

I claim:

1. A system for measuring fluid forces on an impeller shaft of mixing apparatus which is driven by a drive mechanism mounted on support members which comprises means for measuring the movement of the drive mechanism when the impeller shaft is rotating with respect to the position of the drive mechanism when the impeller shaft is not rotating, and means for detecting the fluid forces in response to the magnitude of said movement.

2. The system according to claim 1 wherein said measuring means comprises a proximity gage located adjacent to said drive mechanism, and means for obtaining an output from said gage corresponding to the distance between said mechanism and said gage which represents the fluid forces, said detecting means being responsive to said output signal.

3. The system according to claim 2 wherein said mechanism comprises a gear box having a housing of metallic material, said gage being a magnetic flux density responsive proximity gage located adjacent to the exterior surface of said exterior wall.

4. The system according to claim 1 further comprising means for amplifying the movement of said mechanism including a member extending therefrom in a direction axially of said shaft, said gage being disposed adjacent to said member.

5. The system according to claim 1 wherein said mixing apparatus includes at least one member flexurally supporting said mechanism.

6. The system according to claim 5 wherein said member is at least one beam spanning the tank of said mixing apparatus.

7. A system for controlling mixing apparatus having a motor driven drive mechanism coupled to a shaft having a mixing impeller thereon disposed in a tank for mixing material therein in reponse to fluid forces on said impeller which deflect said shaft, said system comprising means for detecting the movement of said drive mechanism to produce signals representing said fluid forces, and means for controlling said motor in response to said signals.

8. The system according to claim 7 wherein said controlling means comprises means for reducing the speed of said motor when said output signals represent fluid forces which produce excessive deflection of said shaft.

9. The system according to claim 7 wherein said drive mechanism comprises a gear box from which said shaft depends into said tank, and said detecting means comprises a gage responsive to the displacement thereof with respect to said gear box disposed adjacent to said gear box.

10. The system according to claim 7 wherein said drive mechanism comprises a gear box from which said shaft depends into said tank, amplifying means comprising a member connected to said mechanism and extending therefrom in a direction axially of said shaft and opposite to said shaft, said detecting means comprising a proximity gage disposed adjacent to said member.

11. The system according to claim 7 further comprising means flexually supporting said drive mechanism to allow pivotal motion thereof about a flexure axis perpendicular to said shaft, and said detecting means comprising a proximity gage disposed adjacent to said mechanism and responsive to the amplitude of said pivotal motion.

12. A system according to claim 7 wherein said drive mechanism includes a gear box having a housing, at least one beam extending along a flexure axis and spanning said tank upon which said gear box is mounted, said housing having a wall with an exterior surface parallel to said beam, said detecting means including a proximity gage mounted adjacent to said exterior surface.

13. The system according to claim 12 wherein said detecting means is operative for detecting the amplitude of pivotal motion of said gear box about said flexure axis to provide said signals, and said contolling means comprises means for processing said signals to provide outputs to decrease the speed and stop said motor depending upon the peak amplitude thereof.

14. The method of measuring fluid forces on an impeller shaft of a mixing apparatus which shaft is driven by a drive mechanism mounted on support members which comprises the steps of measuring the movement of said mechanism when the impeller shaft is rotating with respect to the position of the drive mechanism when the impeller shaft is not rotating, and detecting said fluid forces from said measurement.

15. The method according to claim 14 wherein said measuring step is carried out by locating a proximity gage adjacent to said mechanism, and obtaining an output from said gage corresponding to the distance between said mechanism and said gage.

16. The method according to claim 15 wherein said mechanism comprises a gear box, and said locating step is carried out by locating the gage adjacent to an exterior wall of said gear box.

17. The method according to claim 14 further comprising the step of amplifying the movement of said mechanism with a member extending therefrom in a direction axially of said shaft, and measuring the movement of said member to provide the measurement of the movement of said mechanism.

18. The method according to claim 14 further comprising supporting said mechanism flexurally.

19. The method according to claim 18 wherein said supporting step is carried out by mounting said mechanism on at least one beam spanning the tank of said mixing apparatus.

20. The method according to claim 18 wherein said supporting step is carried out to support said mechanism for flexure about an axis perpendicular to the axis of said shaft, and said measuring step is carried out by measuring the pivotal movement of said mechanism about said flexure axis.

21. The method according to claim 20 wherein said mechanism includes a gear box having a wall with an exterior surface parallel to said flexure axis, and said measuring step is carried out with a proximity gage located adjacent to said exterior surface.

22. The method according to claim 20 wherein said supporting step is carried out with the aid of at least one beam extending parallel to said flexure axis and spanning the tank of said mixing apparatus into which said shaft extends.

23. The method according to claim 20 wherein said mechanism includes a gear box having a member extending therefrom axially of said shaft in a direction opposite thereto for amplifiying the movement of said gear box, and said measuring step is carried out by locating a proximity gage adjacent to said member along a line spaced from and perpendicular to said flexure axis.

24. The method according to claim 14 wherein said mechanism has a non-rotating metallic housing, and said measurement step is carried out by measuring the magnetic flux density between said housing and the fixed location adjacent thereto.

25. The method of contolling mixing apparatus having a motor-driven drive mechanism coupled to a shaft having an impeller thereon disposed in a tank for mixing material therein in response to fluid forces on said impeller which deflects said shaft, said method comprising the steps of detecting the movement of said drive mechanism to produce signals representing said fluid forces, and controlling said motor in response to said signals.

26. The method according to claim 25 wherein said controlling step comprises reducing the speed of said motor when said output signals represent fluid forces which represent excessive deflection of said shaft.

27. The method according to claim 25 wherein said drive mechanism comprises a gear box from which said shaft depends, and said detecting step is carried out by locating a gage responsive to the displacement of said gear box therefrom disposed adjacent to said gear box.

28. The method according to claim 27 further comprising amplifying the movement of said gear box with the aid of a member connected thereto, and said locating step is carried out with gage adjacent to said member.

29. The method according to claim 28 wherein said flexural supporting step is carried out by mounting said drive mechanism on at least one beam extending along said flexure axis and spanning said tank.

30. The method according to claim 29 wherein said drive mechanism includes a gear box connected to said motor and having a housing mounted on said beam with a wall of said housing having an exterior surface parallel to said beam, said detecting step being carried out by locating a gage responsive to the proximity of an object therefrom adjacent to said wall surface.

31. The method according to claim 27 wherein said detecting step comprises the steps of obtaining said signals from said gage, and said controlling step is carried out by selecting the speed of said motor and response to the amplitude of said signals.

32. The method according to claim 27 wherein said detecting step comprises the steps of obtaining said signals from said gage, and said controlling step comprises the steps of processing said signals to provide output to decrease the speed of and stop said motor depending upon the peak amplitude.

33. The method according to claim 25 further comprising flexurally supporting said drive mechanism to allow pivotal motion thereof about a flexure axis perpendicular to said shaft, and said detecting step is carried out by detecting the amplitude of said pivotal motion.

34. The method according to claim 33 wherein said drive mechanism includes a gear box connected to said motor and having a housing mounted on said beam, amplifying the pivotal movement of said gear box with aid of a member projecting therefrom in a direction axially of said shaft and opposite to said shaft, said detecting step being carried out by locating a gage responsive to its proximity to said member spaced from said member in a direction perpendicular to said flexure axis.

* * * * *